US009512654B2

(12) United States Patent
Armari et al.

(10) Patent No.: US 9,512,654 B2
(45) Date of Patent: Dec. 6, 2016

(54) LOCKING DEVICE

(75) Inventors: Ernest Armari, Horsley Park (AU); Michael Trevor Mackle, Mona Vale (AU)

(73) Assignee: FIRE & SECURITY HARDWARE PTY LTD, Matraville, NSW (AU)

( * ) Notice: Subject to any disclaimer, the term of this patent is extended or adjusted under 35 U.S.C. 154(b) by 18 days.

(21) Appl. No.: 14/118,039

(22) PCT Filed: Apr. 26, 2012

(86) PCT No.: PCT/AU2012/000429

§ 371 (c)(1),
(2), (4) Date: Nov. 15, 2013

(87) PCT Pub. No.: WO2012/155177

PCT Pub. Date: Nov. 22, 2012

(65) Prior Publication Data

US 2014/0183881 A1 Jul. 3, 2014

(30) Foreign Application Priority Data

May 16, 2011 (AU) ..... 2011901857

(51) Int. Cl.
*E05C 3/06* (2006.01)
*E05B 47/00* (2006.01)
*E05B 47/02* (2006.01)

(52) U.S. Cl.
CPC ..... *E05C 3/06* (2013.01); *E05B 47/0012* (2013.01); *E05B 47/023* (2013.01); (Continued)

(58) Field of Classification Search
CPC .... E05B 47/00; E05B 47/001; E05B 47/0012; E05B 47/0046; E05B 47/0047; E05B 2047/0017; E05B 2047/0036; E05B 2047/002; E05B 2047/0024; E05B 2047/0057; E05B 2047/0058; E05B 2047/0067; E05B 2047/0073; E05B 2047/0076; E05B 2047/0094; E05B 47/023; E05B 2047/0087; E05C 3/06
(Continued)

(56) References Cited

U.S. PATENT DOCUMENTS 4,825,027 A 4/1989 Yoon
5,007,261 A * 4/1991 Quantz ..... 70/240
(Continued)

FOREIGN PATENT DOCUMENTS

AU 777 279 B2 10/2004
AU 777279 B2 10/2004
(Continued)

OTHER PUBLICATIONS

International Search Report—Date of Mailing May 25, 2012.
(Continued)

*Primary Examiner* — Alyson M Merlino
(74) *Attorney, Agent, or Firm* — Howard & Howard Attorneys PLLC

(57) ABSTRACT

A locking device is described including: a rotary motor; a worm drive arrangement including a worm and a gear; and a pivotally mounted bolt which is rotatable between a retracted position and an extended position; the motor is arranged to drive the worm to rotate the gear; as the gear rotates it cooperates with a cam formation associated with the bolt to move the bolt between the retracted and extended positions.

4 Claims, 10 Drawing Sheets

(52) U.S. Cl.
CPC . *E05B 2047/002* (2013.01); *E05B 2047/0024* (2013.01); *E05B 2047/0057* (2013.01); *E05B 2047/0058* (2013.01); *E05B 2047/0067* (2013.01); *E05B 2047/0073* (2013.01); *E05B 2047/0076* (2013.01); *E05B 2047/0087* (2013.01); *E05B 2047/0094* (2013.01); *Y10T 292/1062* (2015.04)

(58) Field of Classification Search
USPC ..... 292/201, 199, 229, 341.15, 341.16,292/341.17, 98, 129; 70/275, 277, 278.1, 278.2, 70/278.4, 278.7, 281
See application file for complete search history.

(56) References Cited

U.S. PATENT DOCUMENTS

| | | | | |
|---|---|---|---|---|
| 5,148,691 | A | 9/1992 | Wallden | |
| 6,112,563 | A * | 9/2000 | Ramos | 70/278.1 |
| 6,302,455 | B1 * | 10/2001 | Huang | 292/199 |
| 8,424,934 | B2 * | 4/2013 | Askins | 292/201 |
| 8,876,172 | B2 * | 11/2014 | Denison et al. | 292/144 |
| 2003/0127866 | A1 * | 7/2003 | Martinez et al. | 292/216 |
| 2007/0109097 | A1 * | 5/2007 | Coutermarsh | E05B 47/026 340/5.73 |
| 2009/0178449 | A1 * | 7/2009 | Raatikainen | E05B 47/0012 70/263 |
| 2012/0169453 | A1 * | 7/2012 | Bryla | E05B 47/00 340/3.1 |
| 2013/0088024 | A1 * | 4/2013 | Mackle | E05B 47/0047 292/341.16 |

FOREIGN PATENT DOCUMENTS

| | | | |
|---|---|---|---|
| DE | 299 18 033 | U1 | 2/2000 |
| EP | 1 473 425 | A2 | 11/2004 |
| WO | 2006/115335 | A1 | 11/2006 |
| WO | 2008/066210 | A1 | 6/2008 |

OTHER PUBLICATIONS

International Preliminary Report on Patentability—Date of Mailing Mar. 7, 2013.
European Search Report (EP 12786080.7); Dated: Jul. 6, 2015.

* cited by examiner

LOCKING DEVICE

CROSS-REFERENCE TO RELATED APPLICATION(S)

This application is a national stage application of PCT/AU2012/000429, filed Apr. 26, 2012, which claims priority to Australian Patent Application No. 2011-901857, filed May 16, 2011, the disclosures of which are hereby incorporated by reference in their entirety.

TECHNICAL FIELD

The present invention relates to locking devices and particularly relates to an electromechanical locking device for use at the top or side of a door.

BACKGROUND TO THE INVENTION

Electromechanical locking devices are used in security and access control arrangements for buildings. One such locking device, commonly known as a "drop-bolt", is intended for fitting in the door frame above the top of a door. The device includes an electrically activated bolt which is moveable between an extended position, where it engages with a recess in the top of the door to lock the door, and a retracted position, where the bolt is withdrawn from the recess in the door, allowing the door to be opened.

There is a problem with drop-bolts caused by a condition known as "preload". That is, when the bolt is extended, and there is some sideways pressure on the door, such as caused by a person leaning on the door, or due to differing air pressures on either side of the door, then the locking device may be unable to withdraw the bolt, and so the door is not able to be unlocked.

Some have tried to overcome the problem of preload by way of locking devices which utilise a roller nut that is driven by a screw shaft. The roller nut engages with a pivotal bolt to rotate the bolt to an extended position. However, such devices are typically complex in their construction and involve a large number of moving parts. Locks with large numbers of moving parts can be expensive to manufacture and the large number of parts introduce opportunities for component failure, and provide potential opportunities for intruders to compromise the lock.

SUMMARY OF THE INVENTION

In a first aspect the present invention provides a locking device including: a rotary motor; a worm drive arrangement including a worm and a gear; and a pivotally mounted bolt which is rotatable between a retracted position and an extended position; the motor is arranged to drive the worm to rotate the gear; as the gear rotates it cooperates with a cam formation associated with the bolt to move the bolt between the retracted and extended positions.

The motor may drive the worm by way of a reduction gearbox.

When the bolt is in the extended position, an attempt to force the bolt to rotate to the retracted position may set up a force on the gear, and the direction of the force may be substantially parallel to the direction of a line passing through the axis of rotation of the gear.

The rotation of the gear may be monitored by at least one microswitch.

The locking device may further include a return spring for moving the bolt from the extended to the retracted position.

The locking device may further include a charge storage means; and the lock can be arranged so that, if power to the lock is cut, the motor is powered by the storage means to drive the worm to cause the bolt to move to the retracted position.

In a second aspect the present invention provides a locking device which is arranged to be powered by an external power supply and including: an electric power storage means; and wherein the power storage means is arranged to operate the lock in the event of disconnection or failure of the external power supply to move the lock from a locked to an unlocked condition.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENT

Figure 1:
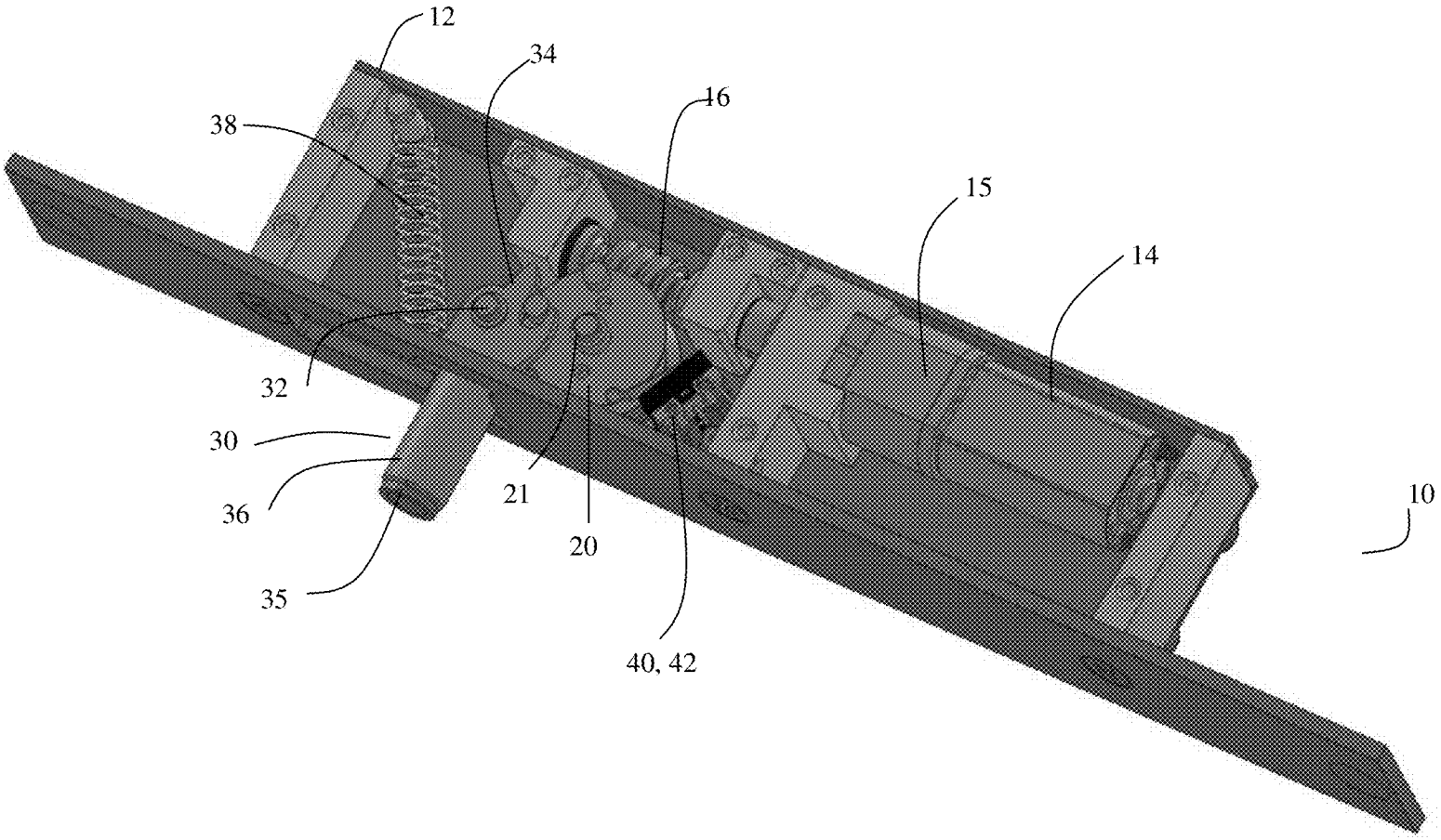
FIG. 1 shows a locking device according to the invention.
Figure 2:
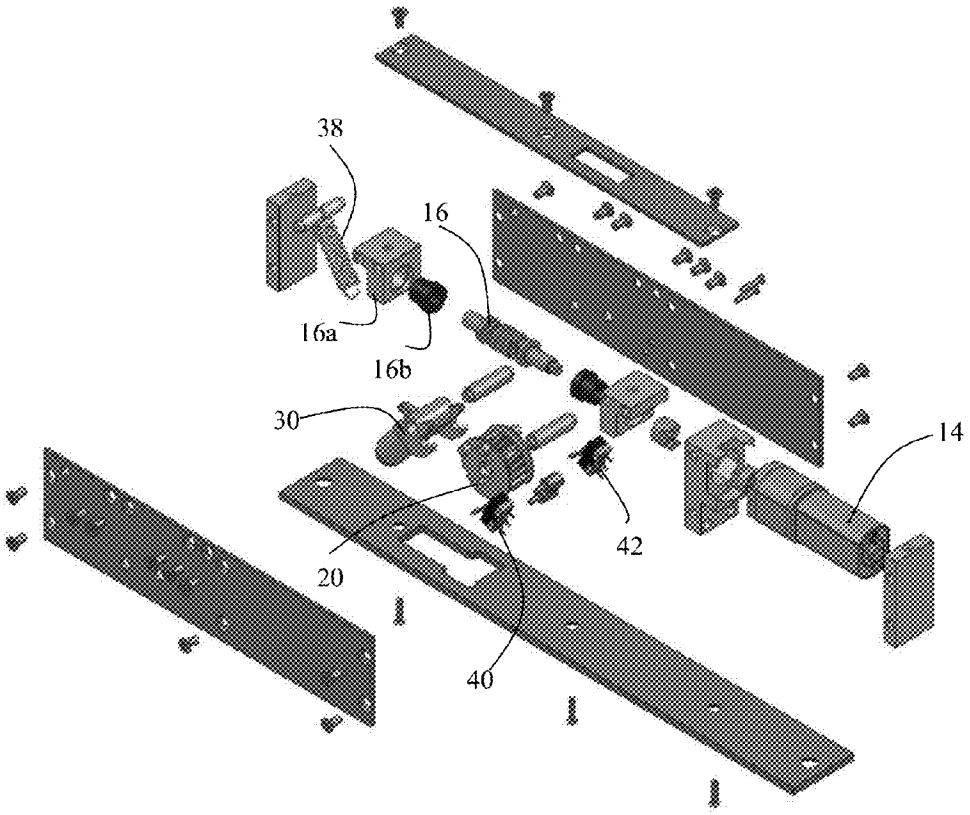
FIG. 2 is an exploded view of the locking device of FIG. 1

Referring to FIGS. 1 and 2, an electro-mechanical locking device 10 is shown including a housing 12 in which is mounted a motor 14 and a worm drive arrangement comprising a worm 16 and a gear 20. Worm 16 is supported by blocks 16*a* and bushes 16*b* and is able to be rotated in either a clockwise or anticlockwise direction by way of motor 14 which drives worm 16 by way of reduction gearbox 15. The locking device further includes a bolt 30 which is pivotally mounted on spindle 32. Bolt includes a bolt body 35 which includes a cam formation 34. A cylindrical hardened steel portion 36 is rotatably mounted to bolt body 35. Gear 20 is pivotally mounted on spindle 21.

Gear 20 includes a first projection 22 and a second projection 24. As gear 20 rotates, these projections cooperate with various surfaces of cam formation 34 as will be described.

Lock 10 includes on onboard controller board which controls the supply of power to the motor to control the lock. Microswitches 40, 42 detect the angular position of gear 20 by way of being actuated when indentations on the gear 20 correspond with the positions of the microswitches.

Figure 3:
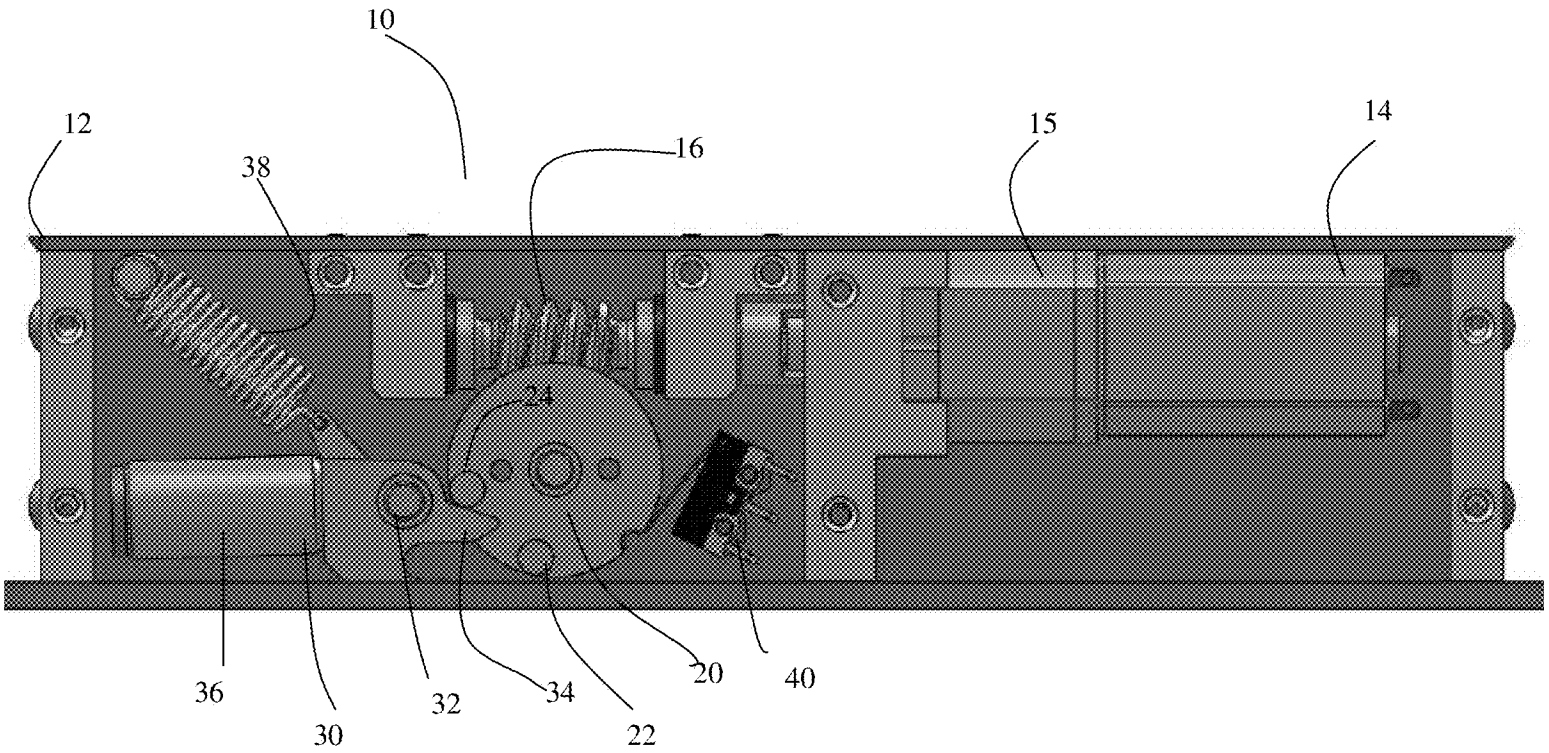
FIGS. 3 to 9 show a sequence of views of the locking device of FIG. 1 in various stages of operation.

In use, the locking device is mounted at the top or side of the doorframe. The bolt 30 is pivotally rotatable between a retracted position as shown in FIG. 3 in which the bolt 30 is in a position so that bolt portion 36 is within housing 12, to an extended position (see FIG. 5) in which the bolt portion 36 extends out of the housing. Bolt portion 36 cooperates with an aperture provided in the top of a door. When the bolt potion 36 is engaged with the aperture, then the door is locked.

Lock 10 includes a power storage device in the form of an on-board super capacitor (not illustrated) which powers the on-board controller and can be used by the on board controller to power the lock in certain circumstances. The super capacitor is maintained in a fully charged state by power supplied by a building control system. In other embodiments, the power storage device may be a battery or other means of storing electric power.

In use, locking device 10 is part of a building wide installation and is controlled in a building from a security control centre in the building. Building control systems typically control locks using either a "two-wire" or a "three-wire" system. In a three-wire system, power is constantly supplied using two of the wires, and a third wire is used to send control signals to the lock. In a two-wire system, the control system can adopt two states in which it either supplies electrical power (typically at 12V or 24V) to the lock, or it does not. The lock 10 can work with either system.

Lock 10 can operate in either of two modes known as "Fail Safe" and "Fail Secure". When used in a three wire system in the Fail Secure mode, when the lock is in the locked condition and power to the lock is lost, then the lock remains locked. When the lock is in the unlocked condition and power to the lock is lost, then the on-board controller uses charge stored in the super capacitor to move the lock to the locked condition.

When used in a three wire system in the Fail Safe mode, when the lock is in the locked condition and power to the lock is lost, then the on-board controller uses charge stored in the super capacitor to unlock the lock. If in the unlocked condition when power is lost, the lock remains unlocked.

In a two wire system, in the Fail Secure mode, the lock is typically arranged to adopt the unlocked position when power is applied to the lock. If power to the lock is lost, then the on-board controller uses the power from the super capacitor to put the lock into the locked condition.

In a two wire system, in the Fail Safe mode, the lock is typically arranged to adopts the locked position when power is applied to the lock. If power to the lock is lost, then the on-board controller uses the power from the super capacitor to put the lock into the unlocked condition.

Operation of locking device 10 in the Fail Safe mode in a two wire system will now be explained with reference to the sequence of FIGS. 3 to 9. Referring to FIG. 3, no power is being supplied to the locking device 10 and it is in the unlocked position with bolt portion 36 inside housing 12.

Figure 4:
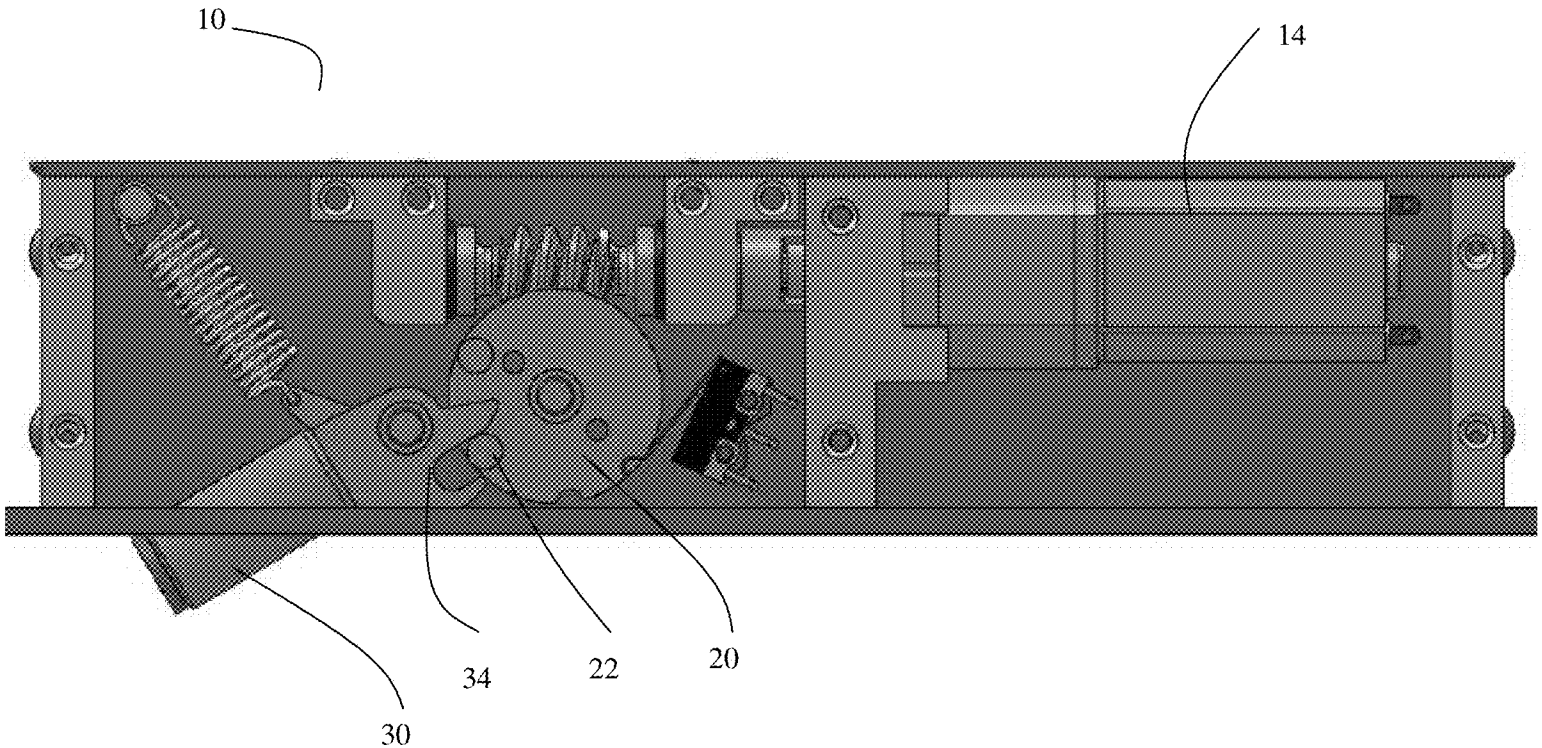

Referring to FIG. 4, power has been supplied by the building control system to the lock which indicates to the lock that it is to move to the locked condition. Power is supplied by the on-board controller to motor 14 to drive worm 16 to cause gear 20 to rotate in a clockwise direction. As gear 20 rotates, projection 22 bears against cam formation 34 to cause bolt 30 to rotate in an anti-clockwise direction against the pressure of return spring 38.

Figure 5:
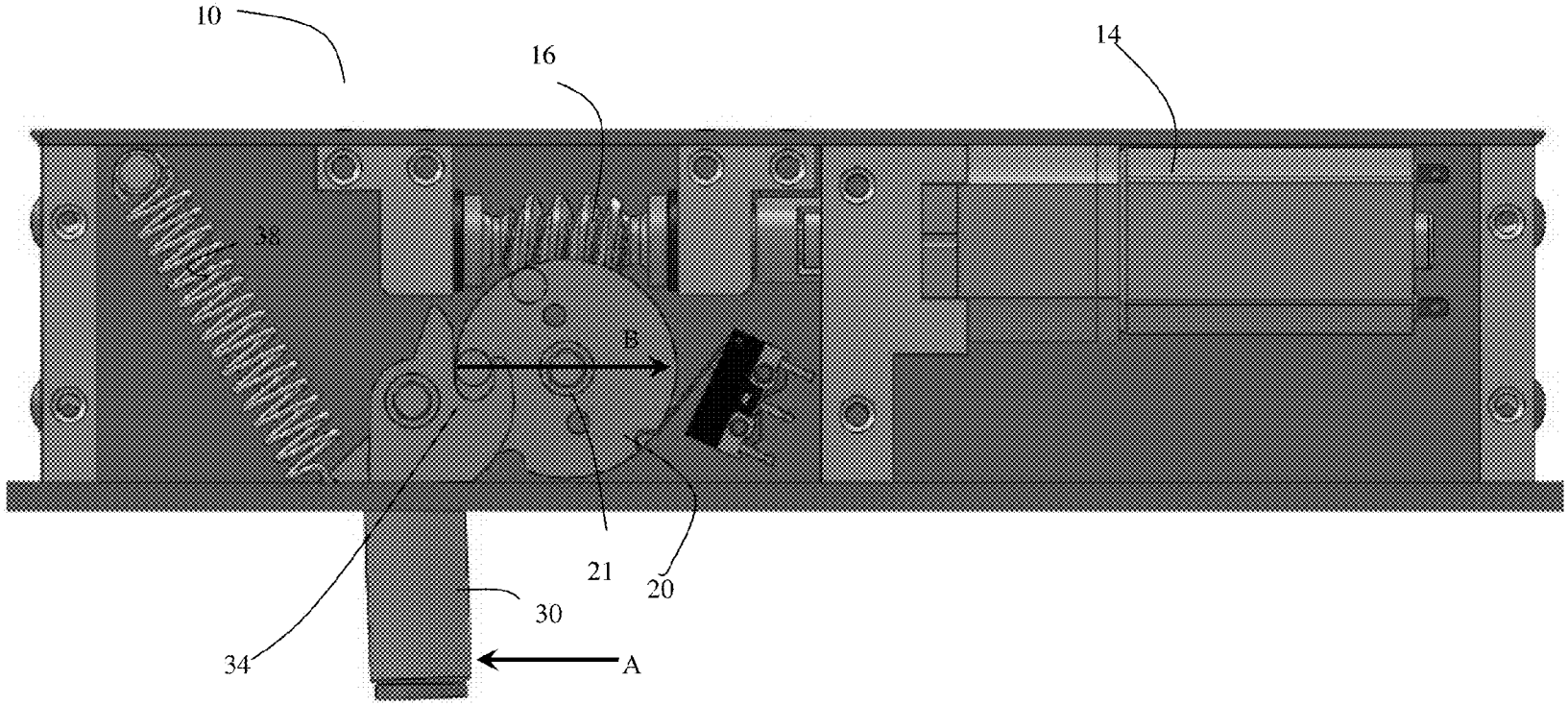

Referring to FIG. 5, motor has continued to drive worm 16 to rotate gear 20 to put bolt 30 into its extended position. When the gear is in the position shown in FIG. 5, micro-switch 40 is released which causes the on board controller to cut power to the motor 14 causing the gear to stop in the position shown. As can be seen, bolt portion 34 extends downwards from housing 12, and in use, would engage with an aperture provided in the top of a door. Another micro-switch (not illustrated) is depressed by the tip of cam formation 34 when bolt 30 in the extended position. This provides confirmation to the on-board controller that the bolt is properly deployed. Failure of the detection of the correct deployment of the bolt will result in the onboard controller indicating an error condition.

Of particular note is the way the lock 10 resists forces applied to bolt portion 34 in an attempt to force bolt portion 34 back inside the housing 12, such as in an attempt to compromise the lock. As shown in FIG. 5, a force applied to the bolt indicated by arrow A sets up a force on the gear indicated by arrow B. The direction of force B is passes through the axis of rotation of the gear about spindle 21. Therefore, the force is resisted by the inherent strength of gear 20 and the spindle 21 upon which it is mounted. Importantly, no force is transmitted to the worm 16, motor 14 or gearbox 15.

Figure 6:
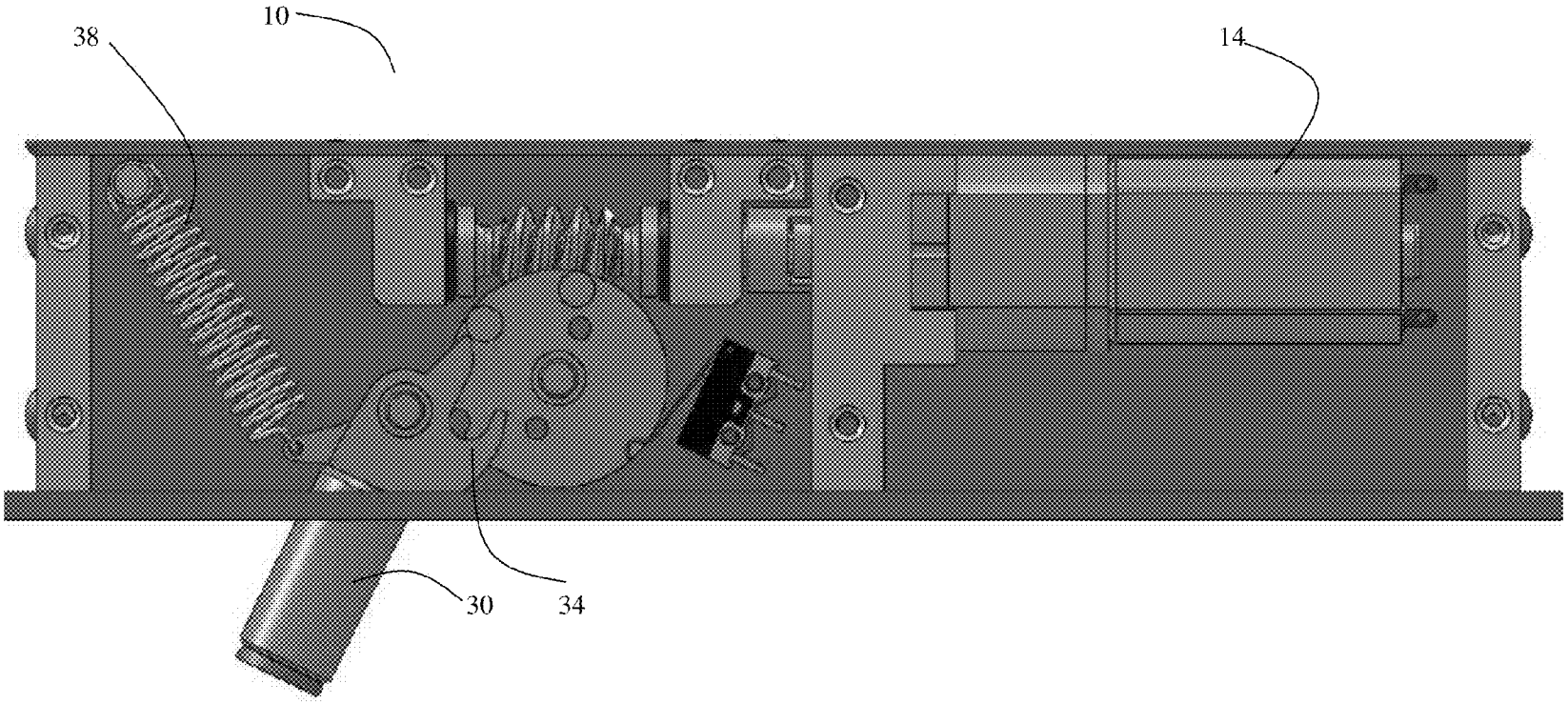

Explanation of returning the lock 10 to the unlocked condition will now be given. Referring to FIG. 6, the building control system ceases supply of electrical power to the lock indicating to the lock that is it to move to its unlocked condition. On board controller supplies power from the super capacitor to motor 14 to rotate gear 20 again in a clockwise direction. As shown in FIG. 6, projection 22 is about to pass beyond the pointed end of cam formation 34.

Figure 7:
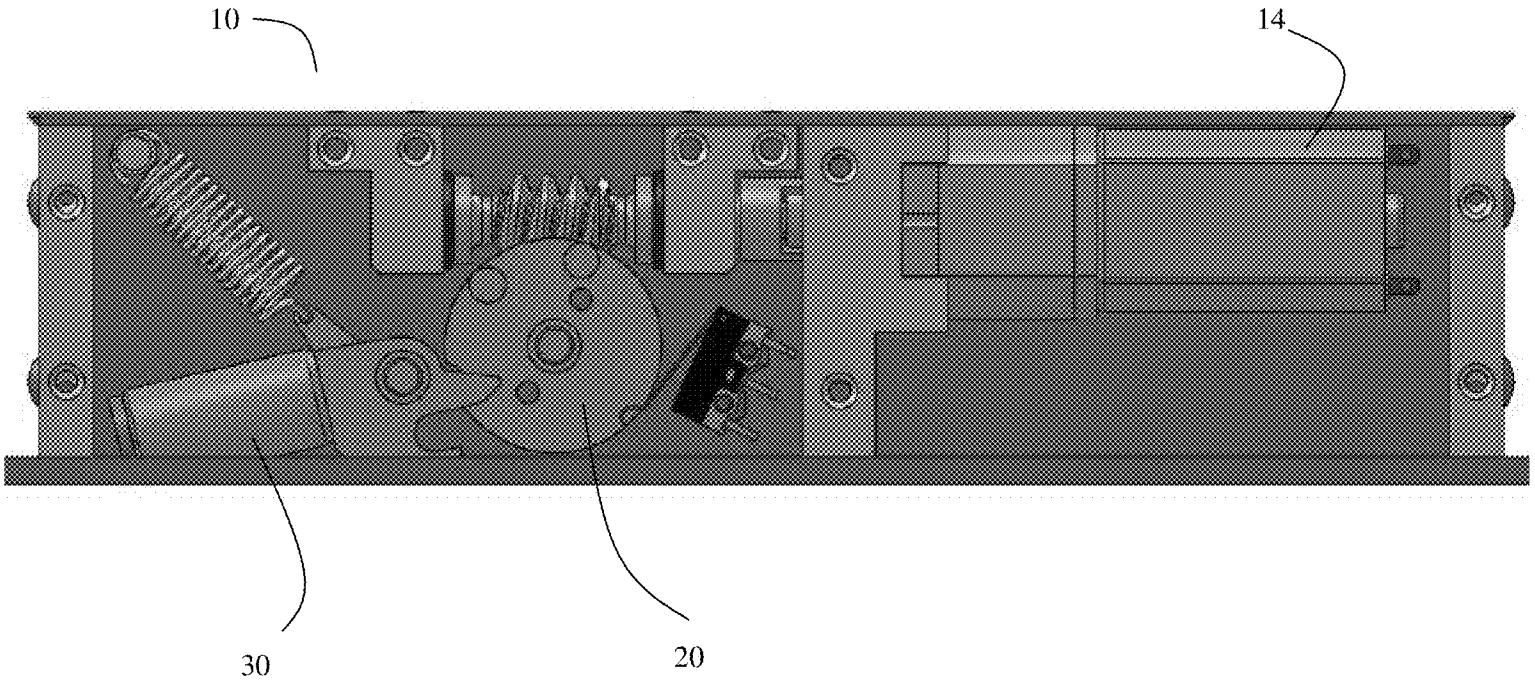

Referring to FIG. 7, gear 20 has rotated further in a clockwise direction to move beyond the pointed end of cam formation 34. Bolt 30 has been rotated to the retracted position by return spring 38. The return spring arrangement provides a rapid movement of the bolt to allow almost immediate opening of the associated door. A depression in the rim of gear 20 aligns with microswitch 42 which signals to the controller board to reverse the direction of rotation.

Figure 8:
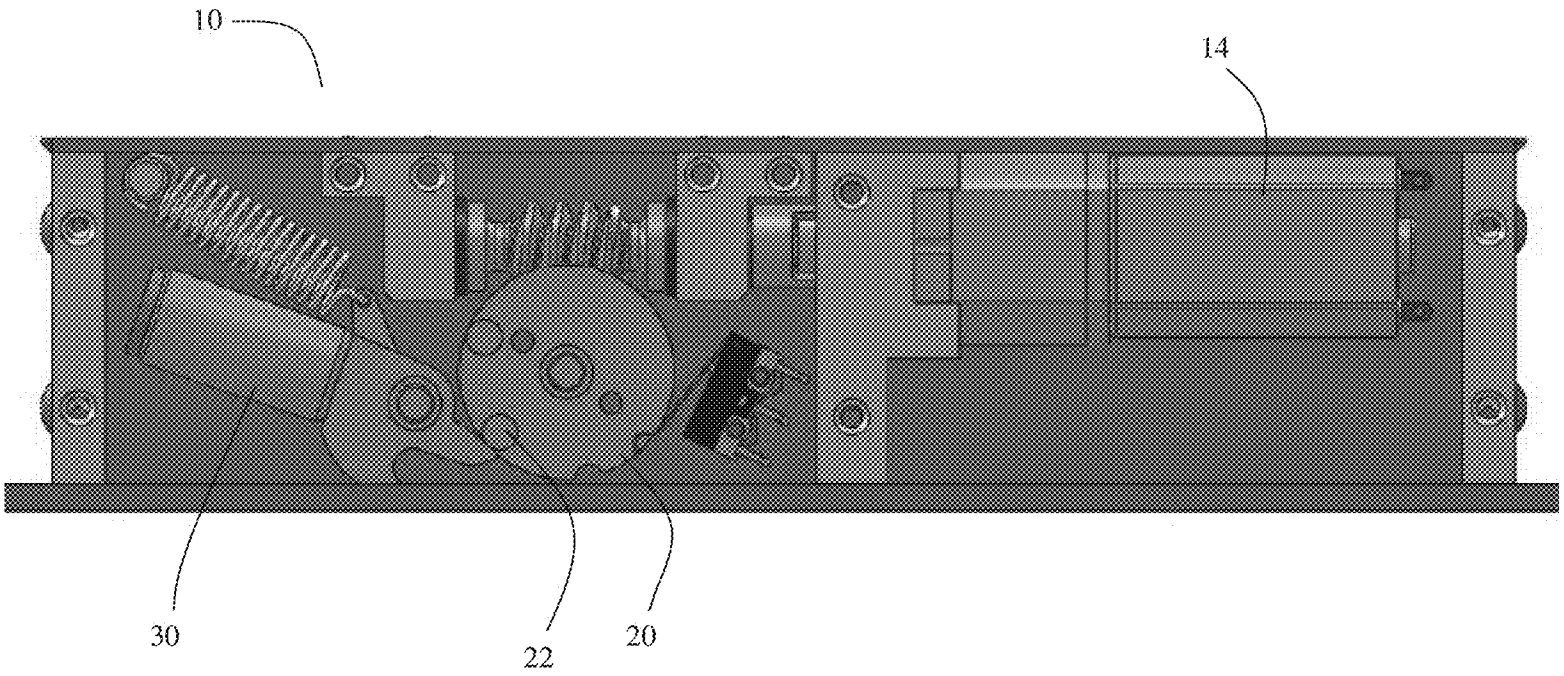

Referring to FIG. 8, controller board has now applied power to motor 14 to cause it to rotate in an opposite direction, to thereby cause gear 20 to rotate in an anti-clockwise direction to return to its home position. Projection 22 is again passing the pointed end of cam formation 34, this time travelling in the opposite direction.

Figure 9:
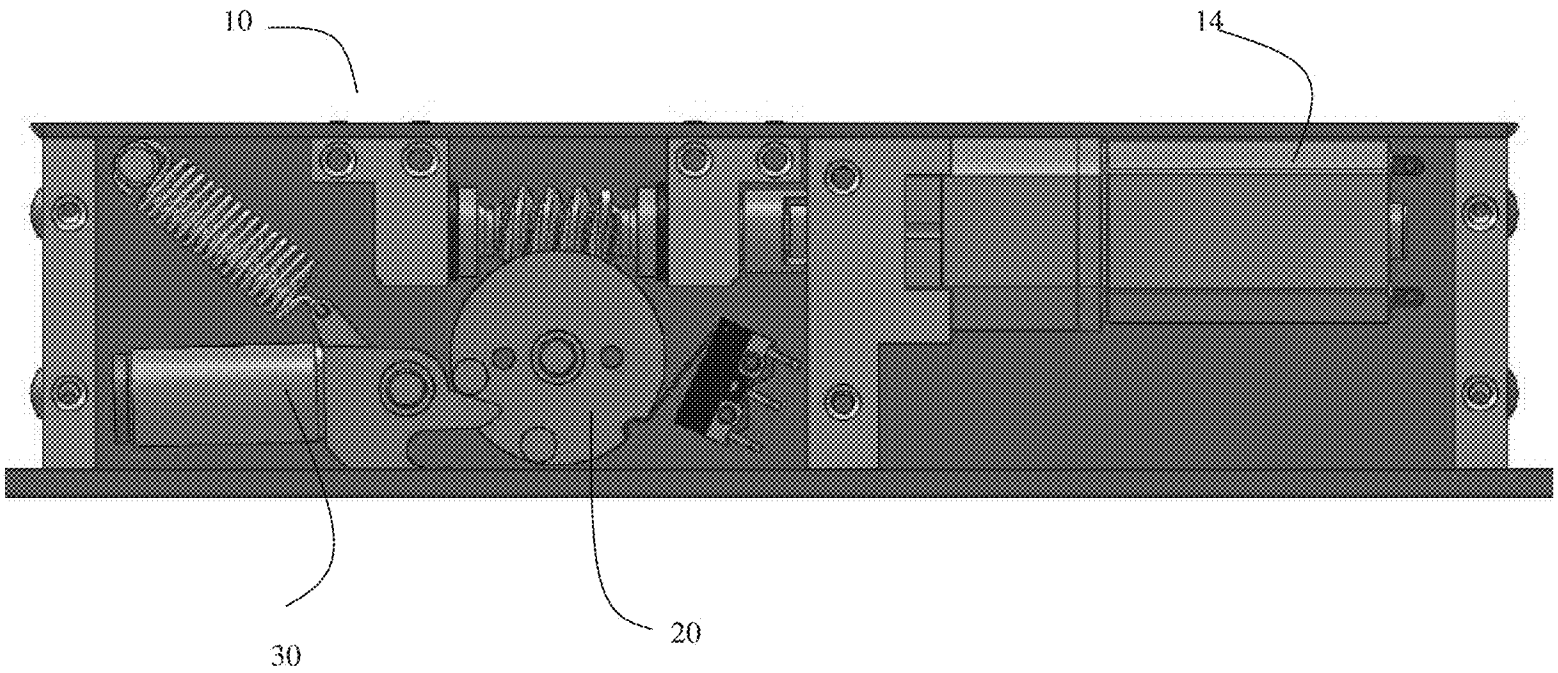

Referring to FIG. 9, gear has now come to rest in its home position, the same as FIG. 1. Lock 10 is now in the unlocked condition. It is to be noted that the second projection 24 is resting on the cam formation 34. This ensures that bolt 30 stays well within the lock housing 12 and avoids drooping of bolt outside the housing. It also puts a little bit of tension on the return spring 38 so that when the worm gear starts to turn gear 20 clockwise (during locking), the cam will engage well with the first projection 22.

Figure 10:
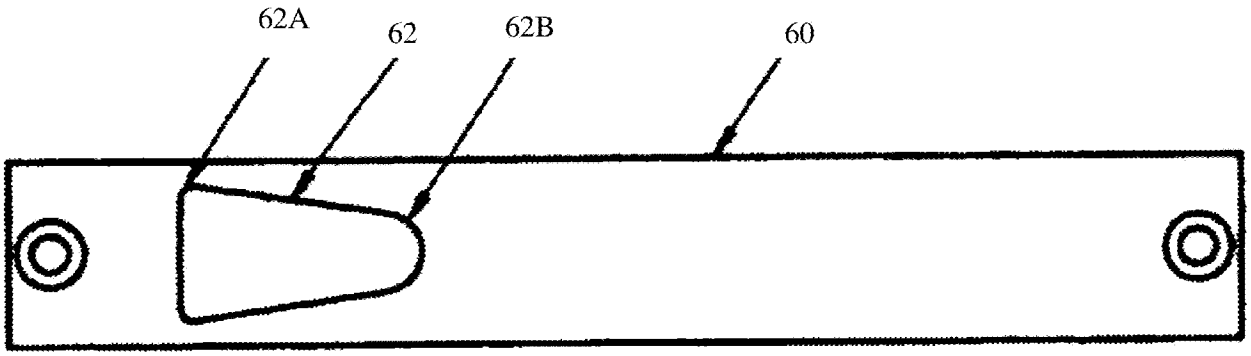
FIG. 10 shows an aperture plate for use with the locking device of FIG. 1.

Referring to FIG. 10, an aperture plate 60 is shown which is used in conjunction with locking device 10. Aperture plate 60 is arranged to be fitted to the top or side of the door, and the bolt 31 of locking device 10 engages with the aperture 62. It can be seen that aperture 62 has a wide end 62A and a narrow end 62B. As bolt 31 rotates to the locking position, the bolt portion 34 enters aperture 62 at the wide portion 62A. Then, as bolt rotates further to the locked position, bolt portion comes to rest at the narrow portion 62B of aperture 62. This arrangement helps to avoid problems that can be caused by potential misalignment of the door that is being controlled. The bolt portion 34 has a larger target area to enter the aperture at its wide end, and the sloped sides of the aperture going from wide portion to narrow portion cause the bolt 34 to correctly align the door as it moves to its locked position. As bolt 30 moves to its locked position, hardened portion 36 is free to rotate to reduce friction.

It can be seen that embodiments of the invention have at least the following advantages:

- Locking device of simplified construction with good pre-load characteristics
- Locking device tolerates misalignment of doors
- On board power supply enables fail safe operation Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A locking device comprising:

a rotary motor;

a worm drive arrangement including a worm and a gear; and a pivotally mounted bolt which is rotatable between a retracted position in which the locking device is in an unlocked condition and an extended position in which the locking device is in a locked condition;

the motor is arranged to drive the worm to rotate the gear;

as the gear rotates, it cooperates with a cam formation associated with the bolt to move the bolt between the retracted and extended positions;

a return spring for moving the bolt from the extended position to the retracted position;

a controller; and, an internal charge storage means, the controller arranged to operate the locking device in a fail safe mode so that the motor is powered by the storage means to drive the worm to cause the bolt to move to the retracted position in response to external power to the lock being cut.

2. A locking device according to claim 1 wherein the motor drives the worm by way of a reduction gearbox.

3. A locking device according to claim 1 wherein when the bolt is in the extended position, an attempt to force the bolt to rotate to the retracted position sets up a force on the gear, and the direction of the force is substantially parallel to the direction of a line passing through an axis of rotation of the gear.

4. A locking device according to claim 1 wherein the rotation of the gear is monitored by at least one microswitch.

* * * * *